United States Patent [19]

Briska et al.

[11] Patent Number: 4,539,227

[45] Date of Patent: Sep. 3, 1985

[54] METHOD OF MAKING A METALLIC SOAP LAYER AS A GLIDING LAYER ON A METALLIZED RECORD CARRIER

[75] Inventors: Marian Briska, Rottenburg-Baisingen; Dietrich J. Bahr, Herrenberg, both of Fed. Rep. of Germany

[73] Assignee: International Business Machines Corporation, Armonk, N.Y.

[21] Appl. No.: 572,087

[22] Filed: Jan. 18, 1984

[30] Foreign Application Priority Data

Jan. 21, 1983 [EP] European Pat. Off. ..... 83100529.3

[51] Int. Cl.[3] ..... B05D 3/10; B05D 5/08

[52] U.S. Cl. ..... 427/179; 427/209; 427/250; 427/333; 427/404; 427/411; 427/419.8

[58] Field of Search ..... 427/177, 179, 419.8, 427/250, 209, 333, 404, 411

[56] References Cited

U.S. PATENT DOCUMENTS 4,381,322 4/1983 Bahr et al. ..... 427/333 X 4,387,119 6/1983 Bahr et al. ..... 427/404 X

*Primary Examiner*—Evan K. Lawrence

*Attorney, Agent, or Firm*—E. Ronald Coffman

[57] ABSTRACT

A sufficiently thick gliding layer is produced on the recording surface of a record carrier of the type comprising an aluminum layer applied over a lacquer layer coated on a support layer. The back surface of the support layer is also coated with a lacquer layer. A fatty acid or a mixture of fatty acids is admixed with one of the two lacquer layers and a metal-diketone or a metal-keto-ester is admixed with the other lacquer layer in approximately in a stoichiometric ratio to the fatty acid. Following the coating of the material with aluminum in a vacuum, the record carrier material is wound into a roll, and stored.

5 Claims, 1 Drawing Figure

Figure 1:
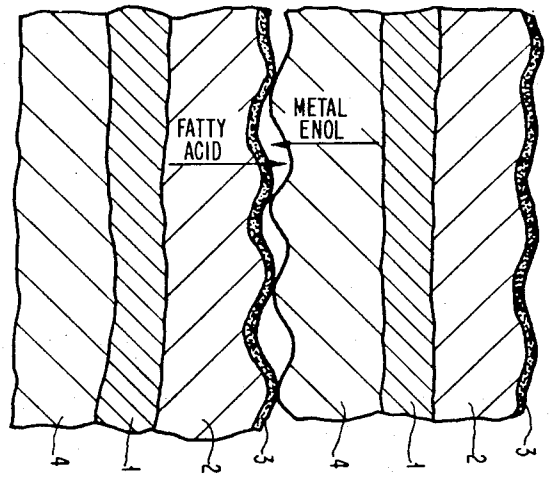

METHOD OF MAKING A METALLIC SOAP LAYER AS A GLIDING LAYER ON A METALLIZED RECORD CARRIER

The invention relates to a method of making a sufficiently thick gliding layer on the surface of a record carrier aluminum layer provided over a carrier layer and a lacquer layer, the back surface of the record carrier being also coated with a lacquer layer, where to at least one of the two lacquer layers a fatty acid or a mixture of fatty acids is admixed.

Such a method and its development are known per se from German Auslegeschrift No. 3 007 331 and German Auslegeschrift No. 3 011 591, German Auslegeschrift No. 3, 040 485 and in particular German Auslegeschrift No. 3 040 513.

The basic idea is that by admixing fatty acid with a metal layer during or after its vapor deposition, a metallic soap is formed at least partly on the surface of a metallized record carrier. For that purpose, a fatty acid, e.g,. oleic acid, was introduced e.g. during or after vapour deposition of the aluminum on the carrier material while the carrier was still in the vacuum. It was attempted to control, via the vapor pressure of the fatty acid, the degree of the reaction of the metallic layer with the fatty acid and consequently the thickness of the metallic soap layer produced.

The present invention uses an entirely different approach. Extended tests have revealed that it would be desirable not only to be able to influence the thickness of the gliding layer to be produced, but also to achieve a compact metallic soap layer and, a particularly important point, to gain influence on the duration of the reaction. In that connection it appeared desirable to achieve independence of the fatty acid from the metal of the specific metallic layer.

This object is achieved by admixing to one of the two lacquer layers, 0.5 to 2% by weight of the liquid lacquer of an oligomeric fatty acid. Further, 0.1 to approximately 3% by weight of a metal-diketone or of a metal-ketoester whose hydrogen form presents a distinct keto-enoltauto-mersism is admixed to the other of the two lacquer layers. After the coating of the material with aluminum in a vacuum, the record carrier material is wound into a roll, and stored. The two components can be admixed in a stoichiometric ratio.

The invention will now be described below with reference to embodiments and with reference to the accompanying drawing of which:

FIG. 1 shows an enlarged, cross-sectional view of a record carrier in accordance with our invention, as it would appear in a stored roll.

The drawing depicts a part sectional view of a record carrier wound into a roll, particularly two superimposed spans of a record carrier consisting of a substrate or support layer 1, e.g. paper, a front surface lacquer layer 2, a metallic, preferrably aluminum layer 3, and a back surface lacquer layer 4. These two spans of the record carrier are placed close to each other so that there is an intimate contact between the metallic layer of the lower span and the back surface lacquer layer of the upper span.

By providing the two lacquer layers according to the invention with, respectively, 0.1 to 1% by weight Ca-acetyl acetonate admixed thereto, and respectively 0.5 to 2% by weight of a fatty acid consisting of approximately 80 to 90% dimer and 20 to 10% trimer of tetramer, a mixture is obtained owing to the diffusion of the two components in opposite directions, and consequently to a reaction between the fatty acid and the metal complex.

A typical dimeric fatty acid has the following formula:

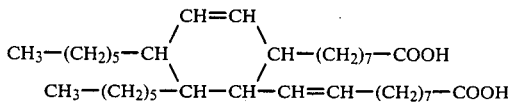

This fatty acid is converted into the respective metallic soap by means of a metal-diketone or metal-keto-ester whose hydrogen form shows a distinct keto-enol-tautomerism.

If however the oligomeric fatty acid is contained in the front surface lacquer layer there will be a certain reaction of the fatty acid with the aluminum already having occurred during the vapor deposition of the aluminum in a vacuum. This reaction contributes, if only moderately, to the forming of an aluminum soap, as described in the above mentioned German Auslegeschrift No. 3 007 331.

Contrary thereto, the metal component of the method according to the invention is not taken substantially from the vapour-deposited metal layer but from the metal complex admixed to the one lacquer layer. In this manner, the forming of the gliding layer is concentrated on the surface of the metal layer.

Below, these processes will be discussed in detail in their most general form.

The reaction is further favourably influenced by the tautomerism with the stabilizing resonance-effect, and by the hydrogen-links, for the driving force of the soap forming reaction is due to the tendency of the diketone-metal-salts to exchange a hydrogen atom against the metal in order to reach the stable enol form.

This will be explained below with reference to the Na-acetyl acetonate example:

In its tautomeric form, the acetyl acetone equilibrium is as follows:

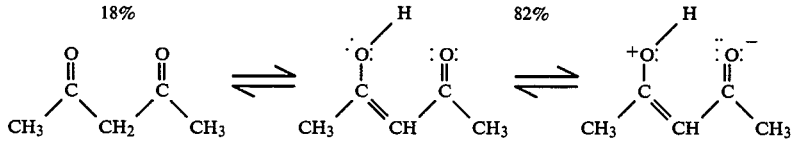

The resonance effect, i.e. the delocalization of electrons always results in the stabilization of the system.

In the compound with sodium, both stabilizing effects are neutralized:

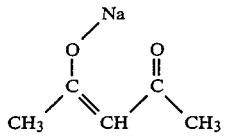

(3)

Actually, the alkali salts of the acetyl acetone are the least stable, the stability increasing in the following order:

Na, K, Ca, Ba, Mg, Al, Cu, Mn, Cr, x, Rh wherein x represents other heavy metals as Co, Zn, Fe, Pb and Mo, V, Zr, Ti.

The bivalent heavy metals form chelates which are of a much higher stability:

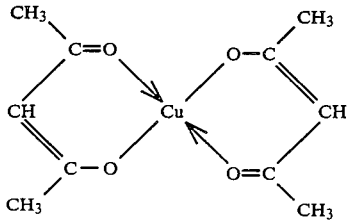

(4)

The arrows represent a co-valent link.

The metal salts of the acetyl acetone (2,4—pentanediones) are not the best ones to use for soap production with respect to an optimum reaction. The selection of the metal and the enol compound depends on the manufacturing process of the paper, and is ruled by the following criteria:

1. The constant of tautomerism $$K_T = \frac{K_a\,(\text{Carbonyl})}{K_a\,(\text{Enol})} \tag{5}$$

increases with the stability of the metal complex.

To give an example: the acetoacetic ester

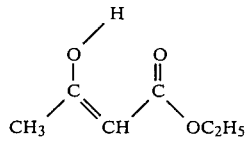

(6)

has a $K_T=6.10^{-2}$, from which it follows that only 7% of this enol formula are present at room temperature.

On the other hand, the acetyl acetone has a $K_T=3.6$, which results in 82% of the enol and 12% of the $\beta$-diketone.

So if an Al-soap were to be produced on the Al-paper, the Al-acetoacetic ester would be a less stable complex than the Al-acetyl acetonate. The lower the stability of the metal complex, the quicker the soap production, and the greater the shifting of the reaction equilibrium toward the right side of the equation of the reaction.

Owing to the lower stability of the Al-acetoacetic ester this compound will therefore always ensure better results.

However, if the acetyl acetone is to be used for technical reasons, a metal should be selected with a less stable complex, i.e. a metal to the left of the Al in the above mentioned stability sequence.

2. The metal soap is formed in accordance with the following reaction:

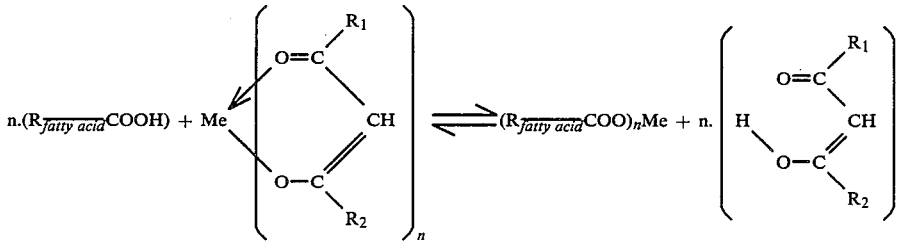

(7)

where $R_{fatty\ acid}$ apart from oleic acid, stearic acid etc. can also be the above mentioned dimeric and trimeric unsaturated fatty acid, and $R_1$ and $R_2$ can be an aliphatic chain, a benzene ring, a cyclical ring or an ester residue.

This reaction equilibrium is abbreviated as follows:

$$nA+B \quad C+nD \tag{8}$$

The thermodynamic equilibrium of this reaction depends on the value of the equilibrium constant K:

$$K = \frac{(C)\cdot(D)^n}{(A)^n\cdot(B)} \tag{9}$$

If the value of K is very low, the reaction equilibrium can also be shifted to the right in that the component D, i.e. the free enol compound disappears from the zone of reaction (interface between Al-front surface and paper back surface) and thus enforces further metal soap production. This is achieved by high diffusion or high volatility of this component, respectively.

Thus, there will be a higher yield of metal soap if a metal complex is used with a symmetrical diketone as 3,5-heptane dione (dipropionylmethane), and a boiling point of 47° C., than with an asymmetrical one as 2,4-heptane dione, 83.6% enol form, with a boiling point of 174° C.;

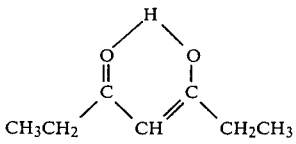

(10)

-continued

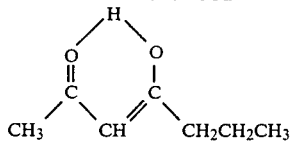

The following table gives some further suitable enols to facilitate the decision on the metal complex to be used.

| Compound | enol at 20° C. | boiling point °C. | melting point °C. |
|---|---|---|---|
| acetyl acetone | 82 | 138–140 | −23.3 |
| diisopropionylmethane | | 66 | |
| 2,4-hexane dione | 80,2 | 158 | |
| benzoyl acetone | 99 | 98–100 | 58–60 |
| dibenzoylmethane | | 219–221 | 77–79 |
| cyclopentane-1,2-dione | 100 | | |
| cyclohexane-1,3-dione | 100 | | 103–105 |
| cyclohexane-1,2-dione | 40 | | |
| cyclooctanone | 9,3 | | |

An advantageous embodiment of the invention is obtained when Ca-acetyl acetonate (melting point 175° C.) and oligomeric fatty acids are used. Both are commercially available with a purity of at least 99%.

The advantages of this method are the following:

1. Metal salts of the $\beta$-diketones are swellable to soluble in organic solvents, and are sufficiently stable therein.
2. Contrary to many metal-organic compounds, the metal salts of the keto-enols are not self-igniting, and are highly flame-resistant.
3. The reaction or formation period, respectively, of the metal soaps can be controlled by suitably selecting the enol and possibly the metal, so that technical conditions can be met to an optimum extent. However, only metals giving a high quality soap can be used: Ca, Ba, Al, Na, etc.
4. The zone of reaction can be limited practically to the surface of the interface between the vapor-deposited Al and the back surface lacquer.
5. Quite thick and compact soap layers can be made so that the gliding effect on the Al-surface is considerably increased, last but not least because it is possible to re-polymerize the oligomeric soaps, by admixing to the back surface lacquer a manganese soap in the form of palmitate or stearate, in a quantity of 0.1 to 0.5% of the liquid lacquer mixture. The Mn-soap acts as a cross-linking, or polymerization catalyst.

We claim:

1. The method of making a record carrier having a recording surface provided with a sufficiently thick gliding layer wherein the record carrier comprises a support layer, a first lacquer layer coated on one surface of said support layer, a second lacquer layer coated on the opposite surface of said support layer, and an aluminum layer formed on said first lacquer layer to provide said recording surface, said record carrier being made according to the improved steps of:

providing in one of said first and second lacquer layers at least one admixed fatty acid, providing in the other of said first and second lacquer layers a metal complex comprising a metal-diketone or a metal keto-ester either of whose hydrogen form shows a distinct keto-enoltautomerism, said metal complex being admixed at approximately a stoichiometric ratio to the fatty acids in said one layer, forming said aluminum layer in a vacuum, winding said carrier into a roll to place said second lacquer layer in contact with said aluminum layer, and storing said wound carrier;

thereby forming a gliding layer resulting from the reaction of said fatty acid and said metal complex.

2. The method, according to claim 1, wherein said at least one fatty acid comprises an oligomeric fatty acid, 80-to-90% of which comprises dimer with the rest comprising trimer and tetramer.

3. The method, according to claim 1, wherein said at least one fatty acid is admixed to said first lacquer layer and the metal-diketone to said second lacquer layer.

4. The method, according to claim 1, wherein said at least one fatty acid comprises the dimer and the trimer of either linoleic acid or octadecadienoic acid, and said metal complex comprises calcium-acetyl acetonate.

5. The method, according to claim 2, wherein said at least one fatty acid comprises the dimer and the trimer of either linoleic acid or octadecadienoic acid, and said metal complex comprises calcium-acetyl acetonate.

* * * * *